US005993062A

United States Patent [19]

Shackleton

[11] Patent Number: 5,993,062

[45] Date of Patent: Nov. 30, 1999

[54] UPSTANDING LIFTING STRAP FOR A BULK CONTAINER

[76] Inventor: William Shackleton, 7580-48th Street S.E., Calgary, Alberta, Canada, T2C 4J6

[21] Appl. No.: 08/882,282

[22] Filed: Jun. 25, 1997

[30] Foreign Application Priority Data

May 13, 1997 [CA] Canada ..... 2205273

[51] Int. Cl.[6] ..... B65D 33/14

[52] U.S. Cl. ..... 383/17; 383/24

[58] Field of Search ..... 383/6, 17, 20, 383/22, 24, 107

[56] References Cited

U.S. PATENT DOCUMENTS

| | | | |
|---|---|---|---|
| Re. 32,308 | 12/1986 | Nattrass . | |
| 4,081,011 | 3/1978 | Krause | 383/24 X |
| 4,224,970 | 9/1980 | Williamson et al. | 383/17 |
| 4,253,507 | 3/1981 | Williamson . | |
| 4,300,608 | 11/1981 | Cuthbertson . | |
| 4,364,424 | 12/1982 | Nattrass . | |
| 4,457,456 | 7/1984 | Derby et al. | 383/17 X |
| 4,499,599 | 2/1985 | Polett et al. . | |
| 4,610,028 | 9/1986 | Nattrass . | |
| 4,710,967 | 12/1987 | Petschner . | |
| 4,792,171 | 12/1988 | Lamy . | |
| 4,822,179 | 4/1989 | Nattrass . | |
| 4,832,506 | 5/1989 | Juel et al. . | |
| 4,925,317 | 5/1990 | Myklebust et al. . | |
| 4,991,979 | 2/1991 | Strand et al. . | |
| 5,002,400 | 3/1991 | Strand . | |
| 5,161,853 | 11/1992 | Polett . | |
| 5,165,802 | 11/1992 | Derby | 383/17 X |
| 5,192,133 | 3/1993 | Juel et al. . | |
| 5,328,267 | 7/1994 | Cuddy et al. . | |
| 5,607,237 | 3/1997 | LaFleur . | |

FOREIGN PATENT DOCUMENTS

| | | | |
|---|---|---|---|
| 1187819 | 5/1985 | Canada . | |
| 2106550 | 5/1994 | Canada . | |
| 2207119 | 1/1989 | United Kingdom | 383/22 |
| 2255072 | 10/1992 | United Kingdom | 383/6 |
| 92014660 | 9/1992 | WIPO | 383/24 |

*Primary Examiner*—Jes F. Pascua
*Attorney, Agent, or Firm*—Rodman & Rodman

[57] ABSTRACT

The invention is a bulk container having at least one lifting strap for lifting and transporting the container, a lifting strap for use with a bulk container and a method for producing a lifting strap. The lifting strap is generally planar, defines a strap plane and is comprised of a material. The lifting strap has first and second ends, a length extending therebetween, first and second edges and a width extending therebetween. Further, the lifting strap is comprised of at least one longitudinal rib extending along a portion of the length of the lifting strap such that the rib urges the lifting strap to raise to an upstanding position for acceptance of a lifting member therein, wherein the rib is comprised of a fixed discontinuity in the material such that the rib extends outside the strap plane.

19 Claims, 2 Drawing Sheets

FIG. 1.
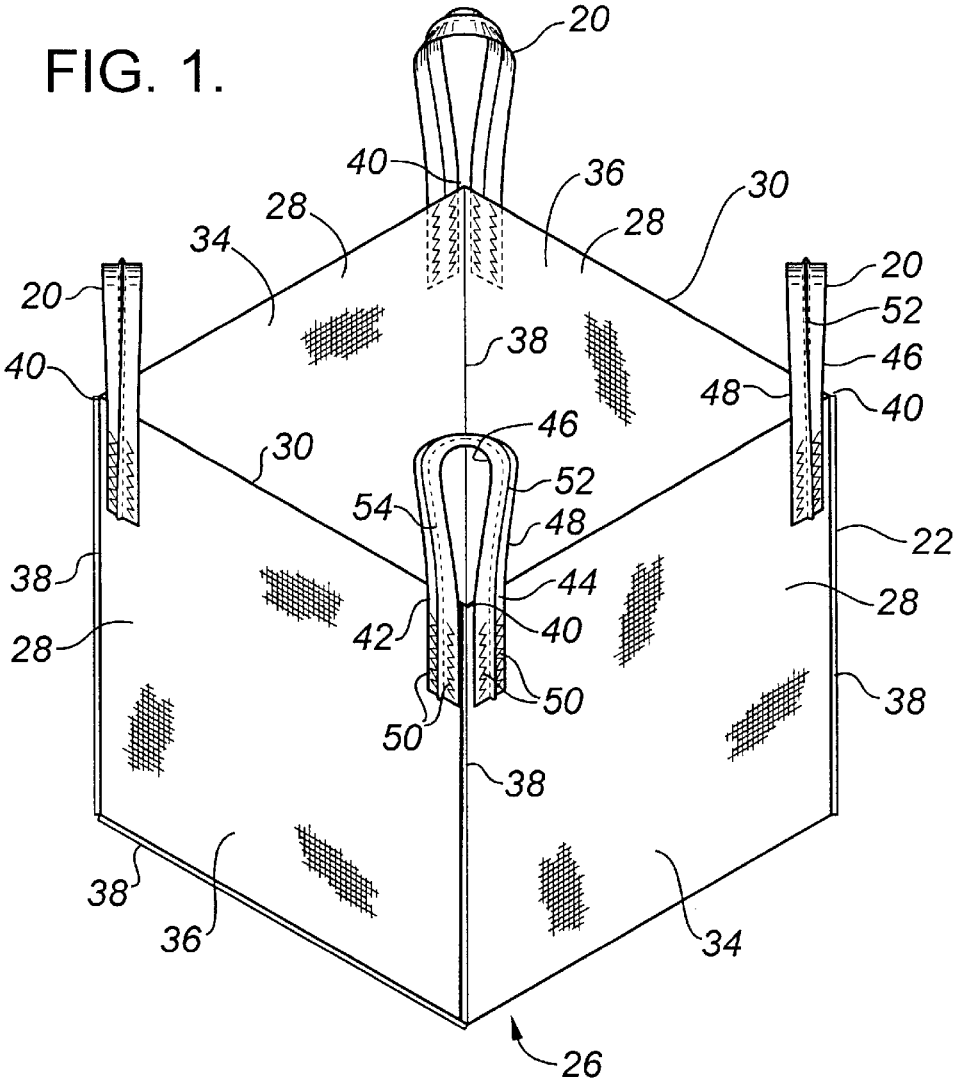
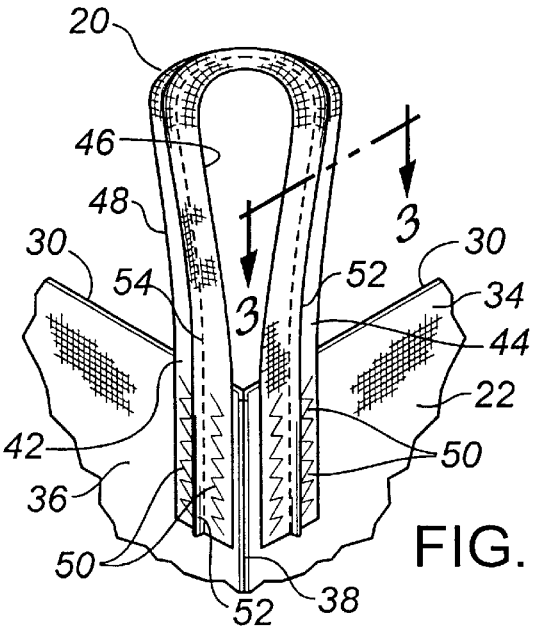
FIG. 2.
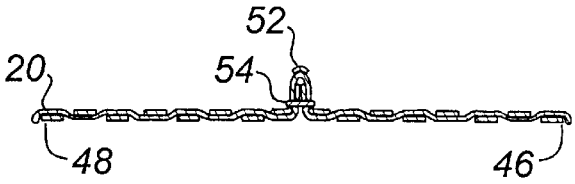
FIG. 3.

FIG. 4.
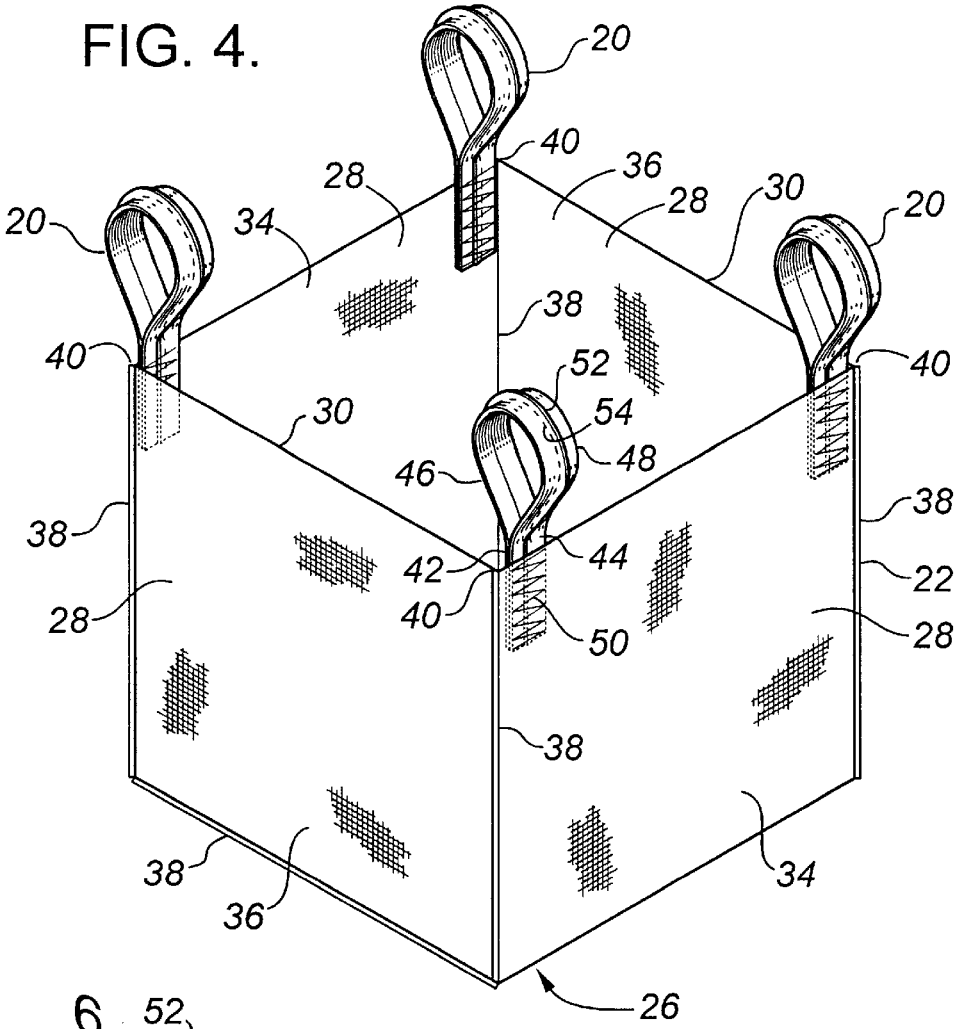
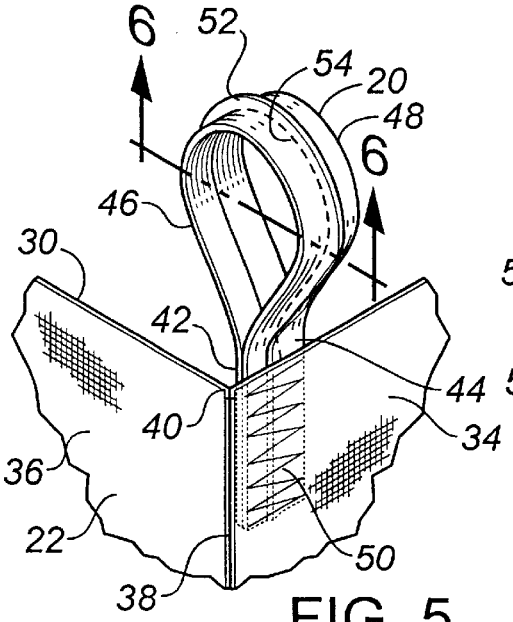
FIG. 5.
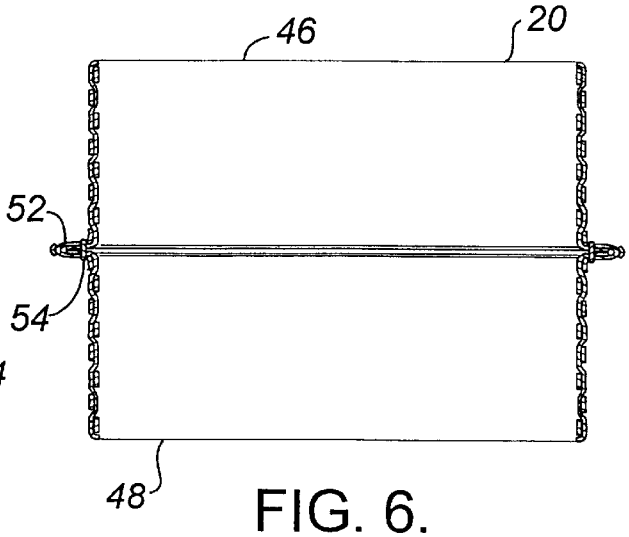
FIG. 6.

UPSTANDING LIFTING STRAP FOR A BULK CONTAINER

TECHNICAL FIELD

The present invention relates to a lifting strap, for use in association with a bulk container, having a longitudinal rib for urging the lifting strap to raise to an upstanding position for acceptance of a lifting member therein. Further, the present invention relates to a bulk container having the lifting strap and a method for producing the lifting strap.

BACKGROUND ART

Bulk containers, often referred to as "flexible intermediate bulk containers" or "FIBCs", are used in the lifting, transportation and storage of bulk materials in powder, granular, flake or other particulate forms. Typically, these bulk containers hold large quantities of these materials, of up to one tonne or more, and are in the form of large bags or sacks made of a flexible woven fabric, such as woven polypropylene or other suitable synthetic materials.

In order to be able to lift and transport the bulk container, lifting loops or lifting straps are associated with the bulk container, typically at an upper edge thereof, so that the bulk container may be transported in an upright position to inhibit spillage of the bulk material from the container. These lifting straps are designed to cooperate with the forks of a forklift, a hook or other lifting device or member such that the forks of the forklift may be accepted or received therein. Broadly speaking, these lifting straps are either integrally formed out of the side wall of the bulk container from the material comprising the bulk container or affixed or fastened in some manner to the side wall of the bulk container. Most commonly, these lifting straps are stitched to the side wall of the bulk container adjacent the upper edge thereof. Further, these lifting straps are typically formed of high strength or high density webbing which is closely woven or braided.

Previously, these lifting straps were required to be manually lifted and placed on the lifting member, i.e. the forks of the forklift. However, more recently, various rigid, semi-rigid and flexible lifting straps have been designed which remain in an upstanding position such that the lifting member may be more readily accepted in the loop formed by the lifting straps in one operation without manual assistance.

U.S. Pat. No. 5,161,853 issued Nov. 10, 1992 to Polett and U.S. Pat. No. 4,499,599 issued Feb. 12, 1985 to Polett et al describe the use of a relatively rigid "tubular member", constructed from rubber, synthetic plastic or like materials. The tubular member encloses or encases the lifting strap to provide support and to maintain the strap in an upstanding position. The tubular member is a separate or distinct element or component apart from the lifting strap and must be assembled onto the strap during the manufacture of the bulk container.

U.S. Pat. No. 4,300,608 issued Nov. 17, 1981 to Cuthbertson describes lifting straps which include "resilient means" such as "an elongated resilient insert" which is incorporated into the lifting strap for forcing the loop formed by the strap into an upstanding position. This elongated resilient insert may take a variety of forms, such as a strip of a resilient plastic or a metallic material inserted into the strap, a plastic or wire material woven into the strap or impregnation of the strap with a plastic material.

U.S. Pat. No. 4,822,179 issued Apr. 18, 1989 to Nattrass describes a lifting strap which is made to be stiffer than a conventional lifting strap by forming it of at least three superimposed layers of material folded and sewn together. This multi-ply construction provides a degree of stiffness to the lifting strap. Further, the multi-ply lifting strap may be twisted 180° to provide added rigidity to the loop formed by the lifting strap.

Each of these upstanding lifting straps requires either the use of additional materials in the form of plastic, metal or rubber tubing, inserts or impregnation or the use of an excessively large amount of the lifting strap material to urge the strap to an upstanding position. In either event, the requirement for these materials, and the associated labor expenses for the assembly or manufacture of these lifting straps, tends to increase the overall costs associated with their production.

There is therefore a need in the industry for an upstanding lifting strap, for use in association with a bulk container, which is relatively inexpensive and which is relatively cost effective to produce as compared to known upstanding lifting straps. Further, there is a need for a bulk container having such a lifting strap and a method for producing it.

DISCLOSURE OF INVENTION

The present invention relates to a lifting strap for use in association with a bulk container for lifting and transporting the container, a bulk container having the lifting strap and a method for producing the lifting strap. More particularly, the invention relates to a lifting strap which is urged towards a raised, upstanding position for acceptance of a lifting member therein, preferably without manual assistance. Further, the present invention relates to a lifting strap which is relatively inexpensive and relatively cost effective to produce as compared to conventional upstanding lifting straps. More particularly, this invention relates to an upstanding lifting strap which does not utilize additional materials such as plastic, metal or rubber tubing, inserts or impregnation, and which does not utilize an excessive amount of the lifting strap material, in order to urge the strap to the upstanding position.

Preferably, the lifting strap is comprised of a longitudinal rib which provides a degree of rigidity or stiffness to the lifting strap. The longitudinal rib is formed from, or out of, the material comprising the lifting strap such that the longitudinal rib is integral therewith and not a separate or distinct piece or insert in the lifting strap. Further, the rib is preferably comprised of a fixed discontinuity in the lifting strap material such that the rib extends outside a plane of the lifting strap.

In a first aspect of the invention, the invention is comprised of an improvement in a bulk container having at least one generally planar lifting strap associated therewith for lifting and transporting the container, wherein the lifting strap is comprised of a material and has a first end, a second end, a length extending between the first and the second ends, a first edge, a second edge and a width extending between the first and the second edges and wherein the lifting strap defines a strap plane. The improvement comprises at least one longitudinal rib extending along at least a portion of the length of the lifting strap such that the rib urges the lifting strap to raise to an upstanding position for acceptance of a lifting member therein, wherein the rib is comprised of a fixed discontinuity in the material such that the rib extends outside the strap plane.

In a second aspect of the invention, the invention is comprised of an improvement in a generally planar lifting strap for use in association with a bulk container for lifting and transporting the container, wherein the lifting strap is comprised of a material and has a first end, a second end, a length extending between the first and the second ends, a first edge, a second edge and a width extending between the first and the second edges and wherein the lifting strap defines a strap plane. The improvement comprises at least one longitudinal rib extending along a portion of the length of the lifting strap such that the rib urges the lifting strap to raise to an upstanding position for acceptance of a lifting member therein, wherein the longitudinal rib is comprised of a fixed discontinuity in the material such that the rib extends outside the strap plane.

In the first and second aspects of the invention, the lifting strap may be comprised of one or more longitudinal ribs, however, preferably, the lifting strap is comprised of one longitudinal rib. Each longitudinal rib may be located or positioned anywhere between the first edge and the second edge of the lifting strap. However, preferably, at least one longitudinal rib is located or positioned about equidistantly from the first edge and the second edge of the lifting strap. Thus, the longitudinal rib is located substantially centrally relative to the width of the lifting strap. Further, each longitudinal rib may extend for any distance between the first end and the second end of the lifting strap. However, preferably, the longitudinal rib extends substantially between the first end and the second end of the lifting strap. Thus, the longitudinal rib extends for the length of the lifting strap. The lifting strap may be of any width and length suitable for, and compatible with, its intended use. However, preferably, the width of the lifting strap is between about three (3) and ten (10) centimeters.

Further, the lifting strap may be associated with the bulk container in any manner suitable for, and compatible with, the intended use of the lifting strap for lifting and transporting the bulk container. For instance, the lifting strap may be formed from the container such that the lifting strap is integral therewith. However, preferably, the lifting strap is fastened to the container by any suitable method, process, means, mechanism, device or apparatus for fastening the lifting strap to the container. Preferably, the lifting strap is fastened to the bulk container by stitching.

The longitudinal rib may be formed in the material comprising the lifting strap by any known method, process, mechanism, device or apparatus suitable for, and capable of, forming the fixed discontinuity in the material such that the rib extends outside the strap plane. For instance, where the material is woven, the rib may be formed during the weaving of the material such that the rib is comprised of a ridge of the woven material. However, preferably, the rib is comprised of a longitudinal fold in the material comprising the lifting strap. In this instance, the fold forms the fixed discontinuity in the material, which extends outside of the strap plane. The longitudinal fold may be fixed or maintained in the material by any suitable fastener, device, apparatus, method or process capable of fixing or maintaining the fold in the material. However, preferably, the rib is further comprised of longitudinal stitching across the fold, a spaced distance from the apex of the fold, such that the rib extends outside the plane of the lifting strap. More preferably, the stitching is adjacent or in proximity to the apex of the fold such that a relatively narrow fold is fixed in the material.

Finally, the material comprising the lifting strap may be comprised of any material suitable for the intended purpose of the lifting strap. For instance, the material may be comprised of polyolefin, preferably, polypropylene.

In a third aspect of the invention, the invention is comprised of a method for producing a lifting strap, for use in association with a bulk container for lifting and transporting the container, having at least one longitudinal rib as described above. The preferred method is comprised of the steps of: forming a material into a generally planar lifting strap having a first end, a second end and a length extending therebetween, wherein the lifting strap defines a strap plane; folding the lifting strap longitudinally along a portion of the length of the lifting strap; and longitudinally stitching the lifting strap across the fold adjacent the apex of the fold to form a longitudinal rib comprising a fixed discontinuity in the material extending outside the strap plane such that the rib urges the lifting strap to raise to an upstanding position for acceptance of a lifting member therein.

BRIEF DESCRIPTION OF DRAWINGS

Embodiments of the invention will now be described with reference to the accompanying drawings, in which:

FIG. 1 is a pictorial view of a preferred embodiment of a lifting strap fastened to a bulk container in a preferred manner;

FIG. 2 is a pictorial view of the lifting strap shown in FIG. 1;

FIG. 3 is a cross-sectional view of the lifting strap shown in FIG. 2 taken along line 3—3;

FIG. 4 is a pictorial view of the preferred embodiment of the lifting strap fastened to the bulk container in an alternate manner;

FIG. 5 is a pictorial view of the lifting strap shown in FIG. 4; and

FIG. 6 is a cross-sectional view of the lifting strap shown in FIG. 5 taken along line 6—6.

BEST MODE OF CARRYING OUT INVENTION

Referring to FIGS. 1 and 4, the present invention is comprised of at least one lifting strap (20) for use in association or combination with a bulk container (22) such that the bulk container (22) may be lifted and transported by the lifting strap (20). The bulk container (22) may be of any type suitable for the storage or transportation of bulk materials. Typically, these bulk materials are in powder, granular, flake or other particulate forms. Further, the bulk container (22) may be of any size, shape or configuration suitable for the storage or transportation of the specific bulk material sought to be stored or transported therein. In the preferred embodiment, the bulk container (22) is commonly known as a flexible intermediate bulk container (22) or FIBC. The FIBC (22) may be of any type, such as a tubular bag, a flat wall bag or the like.

The bulk container (22) may be comprised of any material or materials suitable for, and compatible with. the intended purpose of the bulk container (22), including rigid or semi-rigid materials. However, the bulk container (22) is preferably comprised of a flexible or semi-rigid material such that the bulk container (22) takes the form of a large bag or sack. For instance, the bulk container (22) may be comprised of woven natural or synthetic materials. However, preferably, the bulk container is comprised of polyolefins, such as polypropylene or polyethylene, in the form of flat narrow woven or fabric tapes. In the preferred embodiment, the bulk container (22) is comprised of woven polypropylene, which is preferably resistant to ultraviolet light. In addition, depending upon the particular use, the bulk container (22) may need to be chemically resistant, hygienic, resistant to decomposition, have good breathing properties or have other particular qualities or characteristics. In addition, the weight and strength of the woven material is dependent upon the size and required capacity of the bulk container (22). As well, where necessary for the particular intended use, such as for finely grained materials or powders or hygroscopic materials, an inner sack or lining may be placed in the bulk container (22). This inner lining is typically comprised of a moisture proof material such as a polyethylene film.

Generally speaking, the body of the bulk container (22) is comprised of a closed or closable lower surface (26) and a side wall (28) extending from the lower surface to an upper edge (30). Preferably, a closure device or mechanism or lid structure is provided at the upper edge (30) such that the bulk container (22) may be closed following the placement of the bulk material therein. The closure device is preferably comprised of a skirt, ring or border edging of any suitable material about the upper edge (30) which may be gathered together and tied to prevent spillage of the bulk materials. However, the closure device may be comprised of any suitable structure, device or mechanism permitting the opening and closing of the bulk container (22) at or adjacent to the upper edge (30). Further, the closure device may be comprised of any suitable material but is typically comprised of a more light weight material than the body or remainder of the bulk container (22).

The bulk container (22) may have any shape or configuration suitable for and compatible with its particular intended use. However, preferably, the bulk container (22) is square or rectangular in shape for ease of storage of the bulk container (22) when filled. Further, the bulk container (22) may be comprised of any number of material pieces or panels affixed or fastened together in any suitable manner such as by gluing, stitching or using any other fastening devices. For instance, the lower surface (26) may be comprised of a single panel fastened to one or more panels comprising the side wall (28). Alternatively, the lower surface (26) may be integral with one or more panels of the side wall (28) such that a single panel forms the lower surface (26) and at least a portion of the side wall (28).

Referring to FIGS. 1 and 4, in the preferred embodiment, the body of the bulk container (22) is either substantially square or rectangular in cross section when filled such that the side wall (28) has four sides. Further, the body of the bulk container (22) is made up or formed out of three panels. A central panel (34) comprises the lower surface (26) and two opposing sides of the side wall (28). Two further side panels (36) comprise the remaining opposing sides of the side wall (28). The side panels (36) are preferably fastened or affixed to the central panel (34) by stitching (38). As a result, four seams extend in the side wall (28) to the upper edge (30), which seams define four corners (40) of the upper edge (30). In the preferred embodiment, heavy duty polyester twine is used for stitching, although, any other suitable stitching may be used.

As stated, the bulk container (22) includes at least one lifting strap (20). Each lifting strap (20) is comprised of a first end (42), an opposing second end (44) and a length extending therebetween. The ends (42, 44) of the lifting strap (20) are defined by the position or location on the lifting strap (20) which meets and joins, or is otherwise associated with, the side wall (28) of the bulk container (22). Preferably, the lifting strap (20) will typically meet the side wall (28) at the upper edge (30). As stated, the length of each lifting strap (20) is defined by the distance between the first and second ends (42, 44). Further, the lifting strap (20) is comprised of a first edge (46), an opposing second edge (48) and a width extending therebetween. Thus, the width of each lifting strap (20) is defined by the distance between the first and second edges (46, 48). Although the width of the lifting strap (20) may vary along the length of the lifting strap (20), preferably, the width of the lifting strap (20) is substantially the same throughout the length of the lifting strap (20). Finally, the lifting strap (20) is generally planar and defines, or is located within, a strap plane.

Preferably, the lifting strap (20) is an elongate, relatively narrow strap in that the width is substantially less than the length. However, the length and the width of the lifting strap (20) may vary depending upon, amongst other factors, the size and capacity of the bulk container (22), the required strength of the lifting strap (20), the desired size of the loop to be formed by the lifting strap (20) for acceptance of the particular lifting member therein, the stiffness or rigidity of the material comprising the lifting strap (20) and the manner of attachment of the lifting strap (20) to the bulk container (22). However, preferably the width of the lifting strap (20) is between about three and ten centimeters.

The number of lifting straps (20) will vary depending upon the size and configuration of the particular bulk container (22) to be lifted and transported by the lifting strap or straps (20). Where greater than one lifting strap (20) is present, preferably the lifting straps (20) are placed equidistantly about the upper edge (30) of the side wall (28) of the bulk container (22) to better support the bulk container (22) during transportation of the bulk container (22). However, the placement of the lifting strap (20) may vary depending upon the particular bulk container (22) with which the lifting strap or straps (20) are associated. In the preferred embodiment, as shown in FIGS. 1, 2, 4 and 5, the bulk container (22) includes four lifting straps (20) placed equidistantly about the upper edge (30) of the side wall (28) of the bulk container (22). Preferably, each of the lifting straps (20) is associated with one of the corners (40) of the upper edge (30).

Each lifting strap (20) of the bulk container (22) may be formed from the body of the bulk container (22), and in particular the side wall (28), such that the lifting strap (20) is integral therewith. In particular, at least a portion of the upper edge (30) of the side wall (28) may be extended to form the lifting strap or the lifting strap may be otherwise formed in or from the upper edge (30) of the side wall (28).

However, in the preferred embodiment, each lifting strap (20) is preferably fastened to the bulk container (22). The lifting strap (20) may be fastened to the side wall (28) at any location or position along or adjacent to the upper edge (30) or in any other position or location permitting the lifting strap (20) to extend away from the upper edge (30) such that the lifting strap (20) is in a position suitable for acceptance of a lifting member of a forklift, hook or other lifting device therein. Any fastener, device, apparatus, mechanism, structure, method or process suitable for fastening the lifting strap (20) to the bulk container (22) in a manner compatible with the use of the lifting strap (20) may be used. Specifically, the manner of fastening the lifting strap (20) to the bulk container (22) must permit the lifting strap (20) to be used to lift and transport the bulk container (22) when filled to capacity. Thus, the manner or mechanism for fastening the lifting strap (20) may vary depending upon the size and capacity of the bulk container (22) and the anticipated weight of the bulk material to be transported therein.

In the preferred embodiment, each lifting strap (20) is fastened to the side wall (28) of the bulk container (22) at the upper edge (30) by stitching the lifting strap (20) to the side wall (28). As shown in FIGS. 1, 2, 4 and 5, the lifting strap (20) is fastened to the side wall (28) at the corners (40) by stitching (50). Preferably, both ends (42, 44) of the lifting strap (20) are stitched directly into the corner (40), both ends (42, 44) are stitched on either side of the corner (40) adjacent thereto or the first end (42) is stitched to one side of the corner (40) adjacent thereto, while the second end (44) is stitched to the other side of the same corner (40) adjacent thereto. Any suitable stitching material compatible with and capable of performing its intended function may be used.

The lifting strap (20) may be comprised of any material suitable for use as a lifting strap (20) for a bulk container (22) which has at least some degree of rigidity or stiffness. Preferably, the lifting strap (20) is comprised of a high strength or high density webbing or woven material. In the preferred embodiment, the material is comprised of polyolefin webbing, and more preferably, polypropylene webbing. The required strength of the webbing is dependent upon, among other factors, the size and capacity of the bulk container (22) and the anticipated weight of the bulk material to be transported therein.

The lifting strap (20) is further comprised of at least one longitudinal rib (52) which provides a further degree of rigidity or stiffness to the lifting strap (22) and acts to urge the lifting strap (20) to raise to an upstanding position for acceptance of the lifting member therein. Each longitudinal rib (52) is comprised of a fixed discontinuity in the material of the lifting strap (20) which extends along at least a portion of the length of the lifting strap (20). The discontinuity is such that the rib (52) formed thereby extends outside of the plane defined by the strap. Preferably, the rib (52) provides a relatively narrow ridge or strip of material, as compared to the width of the lifting strap (20). The discontinuity is fixed in the lifting strap in that the discontinuity is permanently maintained in the material of the lifting strap (20).

In the preferred embodiment, the lifting strap (20) is comprised of a single longitudinal rib (52). However, the lifting strap (20) may be comprised of a greater number of ribs (52) where required to increase the rigidity of the lifting strap (20) to further urge the lifting strap (20) to raise to the upstanding position or where desirable for any other reason. Further, as stated, the rib (52) extends longitudinally in the material of the lifting strap (20) along at least a portion of the length of the lifting strap (20). The portion of the length of the lifting strap (20) along which the rib (52), or each rib (52) if more than one, extends may be varied depending upon, amongst other factors, the degree of rigidity that the rib (52) is required to provide to the lifting strap (20). However, in the preferred embodiment, the rib (52) extends substantially between the first end (42) and the second end (44) of the lifting strap (20).

With respect to the positioning of the longitudinal rib (52) relative to the width, the longitudinal rib or ribs (52) may be located at any position between the first and second edges (46, 48) of the lifting strap (20). However, in the preferred embodiment including one longitudinal rib, the longitudinal rib (52) is located about equidistantly from the first and second edges (46, 48) such that the longitudinal rib (52) is positioned substantially centrally in the lifting strap (20).

Any means, mechanism, process, method, device or apparatus capable of forming or producing the longitudinal rib (52), and in particular the fixed discontinuity in the material of the lifting strap (20), may be used. For instance, where the material is woven, the rib (52) may be formed during the weaving or looming of the material comprising the lifting strap (20) such that the rib (52) is comprised of a ridge of the woven material. As the ridge is woven directly into the lifting strap (20), the discontinuity of the ridge is fixed in the material. The ridge may be in the form of a solid ridge of the material such that the ridge is an accumulation of material at a single location. Alternately, the ridge may be in the form of a permanent wave or fold woven into the material.

However, in the preferred embodiment, the rib (52) is comprised of a longitudinal fold in the material comprising the lifting strap (20). In other words, the material, and thus the lifting strap (20), are folded longitudinally along a portion of the length of the lifting strap (20). The longitudinal fold is then fixedly maintained in the material, as described further below, in order to form the rib (52).

Preferably, the fold is fixedly maintained in the material by a fastener or fasteners located a spaced distance from the apex of the fold such that the rib (52) formed thereby extends outside the plane of the lifting strap (20). More preferably, the fastener or fasteners are located adjacent or in relatively close proximity to the apex of the fold such that a relatively narrow ridge of material comprises the rib (52).

The fold may be fixedly maintained in position by any fastener or fasteners or any method, process, device, apparatus or mechanism for fixing or fixedly maintaining the fold in the material. For instance, the fold may be glued or thermally fused into position. However, in the preferred embodiment, the fold is maintained by stitching (54). Thus, the rib (52) is further comprised of stitching (54) across the fold a spaced distance from the apex of the fold. Although the stitching (54) may be at any spaced distance from the apex of the fold, preferably, the stitching (54) is adjacent or in close proximity to the apex of the fold. Any suitable stitching material compatible with, and capable of performing, its intended function may be used.

The invention is further comprised of a method for producing the lifting strap (20), for use in combination with the bulk container (22), for lifting and transporting the bulk container (22). Although the lifting strap (20) may be produced in any manner, such as those previously described herein, the method is preferably comprised of the steps set out below.

First, a material, as described above, is formed into a generally planar lifting strap (20). The lifting strap (20) has the first end (42), the second end (44), the length extending therebetween, the first edge (46), the second edge (48) and the width extending therebetween, as described above. Further, the lifting strap (20) defines the strap plane.

Second, the lifting strap (20) is folded longitudinally along at least a portion of the length of the lifting strap (20), and preferably, the lifting strap (20) is folded substantially between the first and second ends (42, 44). As well, the apex of the fold may be located at any position between the first and second edges (46, 48). However, as described above, in the preferred embodiment, the apex of the fold is centrally located or equidistantly placed between the first and second edges (46, 48). Thus, to achieve the longitudinal fold, the first and second edges (46, 48) are brought together or moved into contact or proximity with each other.

Finally, the fold is fixedly maintained in the lifting strap (20) by a fastener or fasteners located a spaced distance from the apex of the fold. More preferably, the fold is fixedly maintained in the material at a location adjacent or in close proximity to the apex of the fold so that a relatively narrow ridge of the material comprises the rib (52).

The fold may be fixedly maintained in position by any fastener or fasteners or any method, process, device, apparatus or mechanism for fixing or fixedly maintaining the fold in the material of the lifting strap (20). However, in the preferred embodiment, the lifting strap (20) is longitudinally stitched across the fold to form the longitudinal rib (52) as described above. Specifically, the longitudinal rib (52) is comprised of the fixed discontinuity in the material which extends outside the strap plane. The stitching occurs across the fold a spaced distance from the apex of the fold. Although the stitching may be at any spaced distance from the apex of the fold, preferably, the longitudinal stitching is adjacent or in close proximity to the apex of the fold.

The embodiments of the invention in which an exclusive privilege or property is claimed are defined as follows:

1. In a bulk container having at least one generally planar lifting strap associated therewith for lifting and transporting the container, wherein the lifting strap is comprised of a material and has a first end, a second end, a length extending between the first and the second ends and extending from the bulk container, a first edge, a second edge and a width extending between the first and the second edges and wherein the lifting strap defines a strap plane, the improvement which comprises at least one longitudinal rib extending along at least a portion of the length of the lifting strap such that the rib urges the lifting strap to raise to an upstanding position for acceptance of a lifting member therein, wherein the rib is comprised of a longitudinal fold in the material between the first edge and the second edge such that the rib extends outside the strap plane.

2. The bulk container as claimed in claim 1 wherein the rib is located about equidistantly from the first edge and the second edge of the lifting strap.

3. The bulk container as claimed in claim 2 wherein the rib extends substantially between the first end and the second end of the lifting strap.

4. The bulk container as claimed in claim 3 wherein the longitudinal fold has an apex and wherein the rib is further comprised of longitudinal stitching across the fold adjacent the apex of the fold such that the rib extends outside the plane of the lifting strap.

5. The bulk container as claimed in claim 1 wherein the rib extends substantially between the first end and the second end of the lifting strap.

6. The bulk container as claimed in claim 1 wherein the width of the lifting strap is between about three centimeters and ten centimeters.

7. The bulk container as claimed in claim 1 wherein the longitudinal fold has an apex and wherein the rib is further comprised of longitudinal stitching across the fold adjacent the apex of the fold such that the rib extends outside the plane of the lifting strap.

8. The bulk container as claimed in claim 1 wherein the material is comprised of polypropylene.

9. The bulk container as claimed in claim 1 wherein the lifting strap is fastened to the container.

10. In a generally planar lifting strap for use in association with a bulk container for lifting and transporting the container, wherein the lifting strap is comprised of a material and has a first end, a second end, a length extending between the first and the second ends for extending from the bulk container, a first edge, a second edge and a width extending between the first and the second edges and wherein the lifting strap defines a strap plane, the improvement which comprises at least one longitudinal rib extending along at least a portion of the length of the lifting strap such that the rib urges the lifting strap to raise to an upstanding position for acceptance of a lifting member therein, wherein the rib is comprised of a longitudinal fold in the material between the first edge and the second edge such that the rib extends outside the strap plane.

11. The lifting strap as claimed in claim 10 wherein the rib is located about equidistantly from the first edge and the second edge of the lifting strap.

12. The lifting strap as claimed in claim 11 wherein the rib extends substantially between the first end and the second end of the lifting strap.

13. The lifting strap as claimed in claim 12 wherein the longitudinal fold has an apex and wherein the rib is further comprised of longitudinal stitching across the fold adjacent the apex of the fold such that the rib extends outside the plane of the lifting strap.

14. The lifting strap as claimed in claim 10 wherein the rib extends substantially between the first end and the second end of the lifting strap.

15. The lifting strap as claimed in claim 10 wherein the width of the lifting strap is between about three centimeters and ten centimeters.

16. The lifting strap as claimed in claim 10 wherein the longitudinal fold has an apex and wherein the rib is further comprised of longitudinal stitching across the fold adjacent the apex of the fold such that the rib extends outside the plane of the lifting strap.

17. The lifting strap as claimed in claim 10 wherein the material is comprised of polypropylene.

18. The lifting strap as claimed in claim 10 wherein the lifting strap is fastened to the container.

19. A method for producing a lifting strap for use in association with a bulk container for lifting and transporting the container, comprising the steps of:

(a) forming a material into a generally planar lifting strap having a first end, a second end, a length extending between the first and second ends for extending from the bulk container, a first edge, a second edge and a width extending between the first and second edges and wherein the lifting strap defines a strap plane;

(b) folding the lifting strap longitudinally along a portion of the length of the lifting strap to form a longitudinal fold between the first edge and the second edge extending outside of the strap plane, wherein the longitudinal fold has an apex; and (c) longitudinally stitching the lifting strap across the fold adjacent the apex of the fold to form a longitudinal rib comprising the longitudinal fold extending outside the strap plane such that the rib urges the lifting strap to raise to an upstanding position for acceptance of a lifting member therein.

* * * * *